United States Patent [19]

Matsuda et al.

[11] 4,021,205

[45] May 3, 1977

[54] SINTERED POWDERED FERROUS ALLOY ARTICLE AND PROCESS FOR PRODUCING THE ALLOY ARTICLE

[75] Inventors: Takayuki Matsuda; Yoichi Shimizu; Hiroki Shimizu; Kazushi Imazaki; Setsuo Nii, all of Okaya, Japan

[73] Assignees: Teikoku Piston Ring Co. Ltd.; Honda Motor Co., Ltd., both of Tokyo, Japan

[22] Filed: June 8, 1976

[21] Appl. No.: 693,770

[30] Foreign Application Priority Data

June 11, 1975 Japan ..... 50-69571
Feb. 9, 1976 Japan ..... 51-12362

[52] U.S. Cl. ..... 75/246; 75/200; 75/203; 75/204; 75/126 A; 75/126 C; 75/126 F; 75/126 H

[51] Int. Cl.[2] ..... B22F 3/00

[58] Field of Search ..... 29/182.7, 182.8; 75/200, 203, 204, 126 A, 126 C, 126 F, 126 H

[56] References Cited

UNITED STATES PATENTS

| | | | |
|---|---|---|---|
| 3,793,691 | 2/1974 | Takahashi et al. | 75/200 |
| 3,837,816 | 9/1974 | Takahashi et al. | 29/182 |
| 3,942,954 | 3/1976 | Fehn | 29/182.7 |
| 3,967,935 | 7/1976 | Frehn | 75/126 |

*Primary Examiner*—Brooks H. Hunt
*Attorney, Agent, or Firm*—Murray and Whisenhunt

[57] ABSTRACT

A sintered powdered ferrous alloy article having high heat and abrasion resistances and a high workability is produced by admixing, (1) 5 to 30% by weight of a finely divided component alloy which consists of the following composition,

| | |
|---|---|
| 1 to 4% by weight | carbon |
| 10 to 30% by weight | chromium |
| 2 to 15% by weight | nickel |
| 10 to 30% by weight | molybdenum |
| 20 to 40% by weight | cobalt |
| 1 to 5% by weight | niobium |
| the balance | iron, |

(2) 0.8 to 2% by weight of finely divided carbon and (3) the balance of a finely divided ferrous base metal, compression molding the admixture under a pressure of 4 to 6 metric tons/cm$^2$ and sintering the molded admixture in a reducing atmosphere at a temperature of 1050° to 1150° C, the resultant alloy article comprising a matrix component formed from the finely divided carbon and ferrous base metal, numerous particles of the finely divided component alloy dispersed in the matrix and bounding phases formed, around the particles of the finely divided component alloy, from a portion of the matrix and portions of the finely divided component alloy diffused into the portions of the matrix.

7 Claims, 7 Drawing Figures

(x 100)

(x 100)

(x 500)

(x 100)

(x 500)

SINTERED POWDERED FERROUS ALLOY ARTICLE AND PROCESS FOR PRODUCING THE ALLOY ARTICLE

The present invention relates to a sintered powdered ferrous alloy article and a process for producing said alloy article. MOre particularly, the present invention relates to a sintered powdered ferrous alloy article having high heat resistance and abrasion resistance and a process for producing said alloy article. Even more particularly, the present invention relates to a sintered powdered ferrous alloy article useful as valve sheet ring for internal combustion engines, and a process for producing the alloy article.

Generally speaking, it is known that ferrous alloys having high heat and abrasion resistances, contain, as additive elements, chromium, nickel, molybdenum and cobalt which respectively have a high melting point. Accordingly, it is also known that a method for producing an alloy article containing the above-mentioned additive metal elements with the high melting point by way of powder metallurgy, is required to provide a special sintering technique. Such special sintering technique results in high cost and, therefore, is disadvantageous from the point of view of economy.

Generally, conventional sintered powdered ferrous alloys having high heat and abrasion resistances, comprise a matrix component of a ferrous base metal and particles of finely divided component alloy dispersed in the matrix component. In this type of the sintered powdered alloy, the high heat resistive property of the alloy mainly derives from the property of the matrix component, and the abrasion resistive property of the alloy mainly depends on the property of the finely divided metal constituent particles. When in the finely divided component alloy particles, some of the metal elements form a carbide or carbides thereof, the formation of the metal carbide is effective to enhance the abrasion resistance of the sintered powdered alloy article.

However, in the conventional sintering process, the metal elements having a high melting point such as chromium, nickel, molybdenum and cobalt, in the finely divided component alloy particles can diffuse only slightly into the matrix component and, therefore, slightly produce the carbides thereof around the particles. Accordingly, in the conventional powder metallurgy using chromium, nickel, molybdenum and cobalt, it was difficult to produce a sintered powdered alloy article having both the high heat resistance and the high abrasion resistance.

Even if the finely divided component alloy particles have a high abrasion resistance, since the conventional component alloy particles have a poor bonding property to the matrix component, the component alloy particles are easily separated from the matrix component when the sintered powdered alloy article is rubbed with a hard material. The separation of the component alloy article results in a poor abrasion resistance of the sintered powdered alloy article.

An object of the present invention is to provide a sintered powdered ferrous alloy article having both a high heat resistance and a high abrasion resistance and a process for producing the alloy article.

Another object of the present invention is to provide a sintered powdered ferrous alloy article in which particles of a finely divided component alloy are firmly bonded to a matrix component, and a process for producing the alloy article.

According to the present invention, the sintered powdered ferrous alloy having both of high heat resistance and high abrasion resistance can be produced by the process which comprises:

admixing (1) 5 to 30% by weight of a powdered component alloy which consists of a composition of 1 to 4% by weight of carbon, 10 to 30% by weight of chromium, 2 to 15% by weight of nickel, 10 to 30 % by weight of molybdenum, 20 to 40% by weight of cobalt, 1 to 5% by weight of niobium and the balance consisting of iron, (2) 0.8% to 2% by weight of powdered carbon and (3) the balance consisting of powdered ferrous base metal;

compression molding the admixture under a pressure of 4 to 6 metric tons/cm$^2$, and;

sintering the molded admixture in a reducing atmosphere at a temperature of 1050° to 1150° C.

The sintered powdered ferrous alloy article produced by the process of the present invention comprises a matrix component formed from the finely divided carbon and ferrous base metal and particles of the finely divided component alloy dispersed in the matrix and firmly bonded to the matrix with bonding phases formed around the particles. The bonding phases consist of portions of the matrix and portions of the finely divided component alloy diffused into the portions of the matrix.

The present invention is based on the inventor's discovery that when the additive metal elements having a high melting point, such as chromium, nickel, molybdenum, cobalt and niobium are alloyed together in a certain proportion, the resultant alloy has a relatively low melting point and a relatively high diffusing property. That is, when the above resultant alloy is finely divided, admixed with the finely divided carbon and the finely divided ferrous base metal, compression molded under an increased pressure and, then, sintered at an elevated temperature, portions of the component alloy particles can diffuse into the matrix formed from the finely divided carbon and ferrous base metal so as to form bonding phases around the particles and firmly bond the component alloy particles to the matrix. The bonding phase consists of a portion of the matrix and a portion of the component alloy particles diffused into the matrix. Further, it has surprisingly discovered by the inventors that the sintered powdered alloy article of the present invention has not only both high heat and abrasion resistances but, also, a high workability.

In the finely divided component alloy usable for the present invention, the carbon is effective to enhance the flowing property of the melted component alloy when the melted component alloy is cast into ingots from which the finely divided component alloy particles are produced. The carbon also combines with the portions of chromium, molybdenum and niobium to form a complex carbide thereof, and with another portion of niobium to form a simple carbide thereof. When the amount of carbon is smaller than 1% based on the weight of the component alloy, the resultant sintered alloy has a poor abrasion resistance due to small amount of the complex carbide and the simple carbide produced in the sintered alloy. When the amount of carbon in the component alloy is larger than 4%, the resultant complex carbide particles and the simple carbide particles have a large size. Such large size of the carbides results in a relatively low abrasion resistance. Accordingly, it is important that the content of carbon in the component alloy is in a range of from 1 to 4% by weight.

When the molded admixture is sintered in accordance with the process of the present invention, portions of the finely divided component alloy particles can diffuse into portions of the matrix component around the particles and form bonding phases. The bonding phases thus formed contribute to enhance the heat resistance of the alloy article and are effective in firmly bonding the particles to the matrix. This firm bonding of the particles to the matix contributes to enhancement of the abrasion resistance of the alloy article.

In the component alloy of the present invention, a portion of chromium forms the complex carbides with the carbon and another portion of chromium tends to diffuse into the matrix by the sintering operation.

If the content of chromium is lower than 10%, the resultant alloy article has poor heat resistance and abrasion resistance. Otherwise, if the content of chromium is greater than 30%, the resultant component alloy has a poor casting property and is too expensive.

A portion of molybdenum in the component alloy forms the complex carbides and another portion of molybdenum diffuses into the matrix by the sintering operation. Both chromium and molybdenum are effective in enhancing the heat resistance of the sintered powdered alloy article. Additionally, the molybdenum in the component alloy is effective to lower the melting point of the component alloy. This feature of molybdenum will be explained in more detail below.

In accordance with the process of the present invention, a component alloy was prepared by casting a mixture of 3% by weight of carbon, 20% by weight of chromium, 8% by weight of nickel, 10% by weight of molybdenum, 30% by weight of cobalt, 2% by weight of niobium and 27% by weight of iron, at a temperature of 1500° to 1600° C.

A comparative alloy was prepared by the same method as stated above except that molybdenum was used in an amount of 5% by weight and iron in an amount of 32% by weight.

Another comparative alloy was prepared by the same method as stated hereinbefore except that 10% by weight of tungsten was used in place of molybdenum, because it is well-known that tungsten is very effective to enhance the heat and abrasion resistances of a ferrous alloy.

The alloys prepared above had a solidifying property indicated in Table 1.

Table 1

| Alloy | Content (% by weight) Mo | W | Solidifying temperature (° C) started | completed |
|---|---|---|---|---|
| The present invention | 10 | — | 1230 | 1180 |
| Comparative | 5 | — | 1290 | 1220 |
| " | — | 10 | 1310 | 1240 |

Table 1 shows that the component alloy prepared in accordance with the present invention has a lower melting (solidifying) point than that of the comparative alloys. Such lower melting point of the alloy results in a relatively low sintering temperature in the process for producing the sintered powdered alloy article and in low cost of the alloy article.

If the content of molybdenum is lower than 10% by weight, the above-mentioned effects of the molybdenum can not be expected. When the content of molybdenum is greater than 30% by weight, the resultant component alloy has a poor casting property and is disadvantageous from the point of view of economy.

Accordingly, it is required that content of each of chromium and molybdenum in the component alloy is in a range of from 10 to 30% by weight.

The niobium element in the component alloy forms the complex carbide together with chromium and molybdenum and the simple niobium carbide. The niobium is also effective to make the metallurgical texture of the component alloy finer, that is, to make the complex carbide particles in the component alloy finer. When the content of niobium in the component alloy is smaller than 1% by weight, the above mentioned effects of niobium are poor and, therefore, unsatisfactory. When the niobium exists in a content of more than 5% by weight in the component alloy, the resultant particles of the niobium simple carbide have a large size which causes a poor abrasion resistance of the sintered powdered alloy article. Accordingly, it is desired that the content of niobium in the component alloy is in a range from 1 to 5% by weight. Both the nickel element and cobalt element in the component alloy contribute to enhance the heat resistance of the component alloy particles themselves. Further, portions of both these elements can diffuse into portions of the matrix so as to form a bonding phase having a high heat resistance and which is capable of firmly bonding the particles to the matrix. The nickel and cobalt also contribute to enhancement of the heat resistance of the bonding phases and to increasing the mechanical strength of the sintered powdered ferrous alloy article.

Either when the content of nickel is smaller than 2% by weight or when the content of cobalt is smaller than 20% by weight in the component alloy, the resultant component alloy is poor in the effects stated above. Further, either when the content of nickel is greater than 15% by weight, or when the content of cobalt is greater than 40% by weight, the resultant component alloy has a poor casting property and is expensive. Accordingly, it is required that the contents of nickel and cobalt in the component alloy are 2 to 15% and 20 to 40% by weight, respectively.

In the process of the present invention, the admixture to be converted into a sintered powdered alloy article is prepared from 5 to 30% by weight of the finely divided component alloy, 0.8 to 2% by weight of finely divided carbon and the balance of finely divided ferrous base metal. In a preferable embodiment of the present invention, the admixture may be prepared from 10 to 20% by weight of the finely divided component alloy, 1.0 to 1.5% by weight of the finely divided carbon and 78.5 to 89% by weight of the finely divided ferrous base metal.

With respect to the content of the finely divided component alloy, if the content of the finely divided component alloy is smaller than 5%, the resultant sintered powdered alloy article has a poor abrasion resistance and the component alloy particles can not be firmly bonded to the matrix due to poor formation of the bonding phases. Further, if the content of the finely divided component alloy is greater than 30% by weight, the admixture of the finely divided component alloy, carbon and ferrous base metal has a poor molding property and a poor sintering property, and the resultant sintered powdered alloy article has a poor mechanical tenacity, in other words, a high brittleness. Accordingly, it is desired that the content of the finely divided component alloy be between 5 and 30% by weight.

The content of finely divided carbon must be in an amount between 0.8 and 2% by weight. When the content is lower than 0.8% by weight, it results in undesirable deposition of ferrite which has a poor abrasion resistance, in the matrix. When the content of finely divided carbon is in an amount greater than 2% by weight, the resultant sintered powdered alloy article undesirably contains cemmentite formed in the matrix.

The finely divided ferrous base metal consists essentially of iron. That is, the base metal preferably contains 98.5% or more of iron.

In order to produce the sintered powdered alloy article having a high mechanical strength, it is preferable that the particles of the finely divided component alloy have a size of 150 microns or smaller, more preferably, 100 to 150 microns. If the size is greater than 150 microns, the admixture of the finely divided component alloy with the finely divided carbon and ferrous base metal may have a poor molding property, the molded admixture may have a poor sintering property and the resultant sintered powdered alloy article has a relatively low mechanical strength.

The component alloy is prepared from the aforementioned metal element and carbon in the aforementioned composition by way of casting. The resultant ingot of the component alloy is finely divided by milling it using, for example, a stamp mill, ball mill or eddy mill.

The admixing operation, molding operation and sintering operation, in the process of the present invention, each may be effected in accordance with a conventional technique in the art. For the purpose of convenience in the molding operation, 0.5 to 1.5% of a lubricant, for example, zinc stearate, zinc oleate, solid parafin, benzyl oleate, graphite grease, and camphor, may be mixed to the admixture. The admixture is molded under a pressure of 4 to 6 metric tons/cm$^2$ in a desired mold. In this operation, it is preferable that the molded admixture has a density of 6.4 to 6.9 g/cm$^2$, more preferably, 6.6 to 6.7 g/cm$^2$.

The molded admixture is sintered at a temperature of 1050° to 1150° C for a time period long enough to form the bonding phases around the particles of the finely divided component alloy, for example 30 to 60 minutes. The sintering operation is carried out in a reducing atmosphere, for example, hydrogen gas, heat-decomposed ammonia gas and end thermic gas which consists of 45% by weight of hydrogen, 27% by weight of carbon monooxide, less than 1% by weight of carbon dioxide and the balance of nitrogen.

The features and advantages of the present invention will be further illustrated by the following examples with reference to the accompanying drawings, in which.

EXAMPLE 1

Figure 1A:
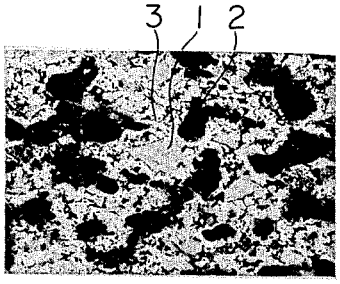
FIGS. 1A and 1B are microscopic views in magnifications of 100 and 500 of a sintered powdered ferrous alloy of the present invention, respectively.

A component alloy was prepared from 2.0% by weight of carbon, 20% by weight of chromium, 8.0% by weight of nickel, 20% by weight of molybdenum, 32% by weight of cobalt, 2.0% by weight of niobium and the balance of iron (containing inevitable impurities), and finely divided by a stamp mill to provide finely divided component alloy particles having a −100 mesh size (Tyler Standard). 6% by weight of the finely divided component alloy was admixed with 1.2% by weight of finely divided carbon and 92.8% by weight of finely divided ferrous base metal consisting of 99.6% by weight of iron, 0.01% by weight of carbon, 0.01% by weight of silicon, 0.26% by weight of manganese, 0.004% by weight of phosphorus and 0.005% by weight of sulfur. As a lubricant, zinc stearate was added in an amount of 1%, based on the weight of the above-prepared admixture to the admixture. The admixture was charged into a mold and compressed at a pressure of 5 metric tons/cm$^2$. The molded admixture was sintered in a heat-decomposed ammonia gas atmosphere at a temperature of 1150° C for 60 minutes.

The resultant sintered powdered ferrous alloy article was subjected to an elementary analysis. It was found that the alloy article consisted of 1.0% by weight of carbon, 1.2% by weight of chromium, 0.48% by weight of nickel, 1.2% by weight of molybdenum, 1.92% by weight of cobalt, 1.2% by weight of niobium and the balance of iron. The sintered powdered alloy article had a density of 6.7 g/cm$^3$, a hardness (HRB) of 82 and a tensile strength of 37.0 kg/mm$^2$.

EXAMPLE 2

The same procedures as in Example 1 were effected with the exception that a finely divided component alloy consisting of 2.0% by weight of carbon, 20% by weight of chromium, 8.0% by weight of nickel, 20% by weight of molybdenum, 32% by weight of cobalt, 2.0% by weight of niobium and the balance of iron was admixed in an amount of 10% by weight with 1.2% of the finely divided carbon and 88.8% by weight of the finely divided ferrous base metal.

The resultant sintered powdered ferrous alloy article consisted of 1.1% by weight of carbon, 2.0% of chromium, 0.8% of nickel, 2.0% of molybdenum, 3.2% of cobalt, 0.2% of niobium and the balance of iron, and had a density of 6.7 g/cm$^3$, a hardness (HRB) of 82 and a tensile strength of 37.5 kg/mm$^2$.

EXAMPLE 3 AND COMPARISON EXAMPLE 1

In Example 3, procedures identical to those in Example 1 were repeated with the exception that 25% by weight of the finely divided component alloy was admixed with 1.2% by weight of the finely divided carbon and 73.8% by weight of the finely divided ferrous base metal.

The resultant sintered powdered alloy article consisted of 1.3% by weight of carbon, 5.0% of chromium, 2.0% of nickel, 5.0% of molybdenum, 8.0% of cobalt, 0.5% of niobium and the balance of iron.

In Comparison Example 1, procedures identical to those in Example 3 were carried out, except that a component alloy was used consisting of 2.0% by weight of carbon, 20% of chromium, 8.0% of nickel, 20% of tungsten, 32% of cobalt, 2.0% of niobium and the balance of iron.

The resultant comparison sintered alloy article consisted of 1.3% by weight of carbon, 5.0% of chromium, 2.0% of nickel, 5.0% of tungsten, 8.0% of cobalt, 0.5% of niobium and the balance of iron.

The sintered alloy articles of Example 3 and Comparison Example 1 had the properties indicated in Table 2.

Table 2

| Example | Content (wt. %) Mo | W | Density (g/cm³) | Hardness (HRB) | Tensile strength (kg/mm²) |
|---|---|---|---|---|---|
| Example 3 | 25 | — | 6.53 | 98 | 33.0 |
| Comparison Example 1 | — | 25 | 6.5 | 91.5 | 29.0 |

Figure 1B:
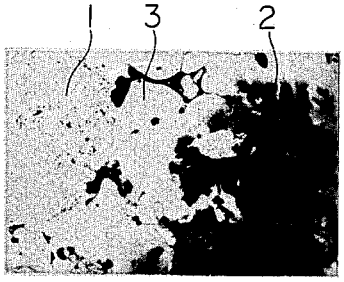
Figure 2A:
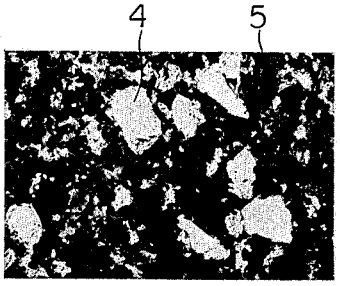
Fig. 2A PRIOR ART
FIGS. 2A and 2B are microscopic views in magnifications of 100 and 500 of a conventional sintered powdered ferrous alloy in a prior art, respectively.
Figure 2B:
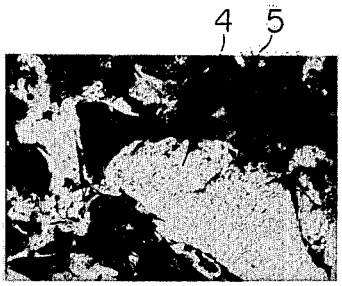
Fig. 2B PRIOR ART

A microscopic view of the metallurgical texture of the sintered alloy of Example 3 is shown in FIGS. 1A and 1B and that of Comparison Example 1 in FIGS. 2A and 2B.

Referring to FIGS. 1A and 1B, numerous particles 1 of finely divided component alloy are surrounded by bonding phases 3 and bonded to the matrix 2 consisting of perlite with the bonding phases 3. Compared with these views, in FIGS. 2A and 2B, numerous particles 4 are directly embedded in the matrix 5 consisting of perlite. That is, in FIGS. 2A and 2B, no bonding phase is observed.

EXAMPLE 4

In Example 4, procedures identical to those in Example 1 were carried out, except that 20% by weight of the finely divided component alloy, 1.0% by weight of the finely divided carbon and 79% by weight of the ferrous base metal were admixed together.

The resultant sintered alloy article consisted of 1.2% by weight of carbon, 4.0% of chromium, 1.6% of nickel, 4.0% of molybdenum, 6.4% of cobalt, 0.4% of niobium and the balance of iron.

The sintered alloy article was subjected to measurement of hardness at elevated temperatures. The results of the measurement are indicated by Curve A in FIG. 3.

For comparison purposes, an article of Stelite No. 6 (trademark of a ferrous alloy produced by Mitsubishi Metal Minning Co., Ltd.) was subjected to the same measurement as above. The results are also indicated by Curve B in FIG. 3.

Figure 3:
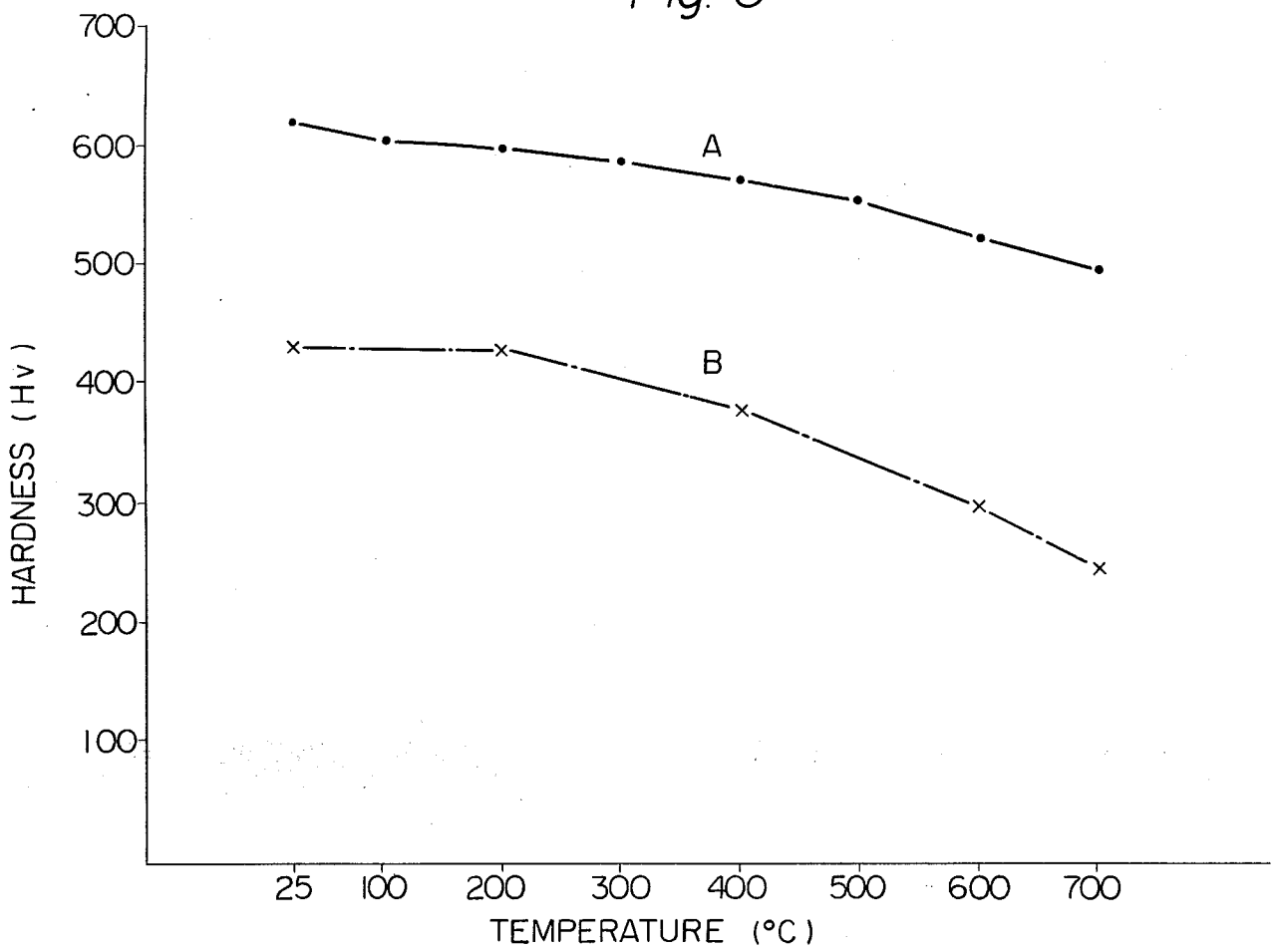
FIG. 3 shows a relationship of the hardness of a sintered powdered alloy article of the present invention to temperature, in comparison with that of a conventional sintered powdered alloy article.

Referring to FIG. 3, it is evident that the hardness of the sintered alloy article of Example 4 is higher than that of Stelite No. 6. Also, it is evident that the hardness of the sintered alloy article of Stelite No. 6 remarkably decreases with the increase of temperature from 200° C to 700° C. That is, the hardness at 700° C is about 250 $H_v$ which is about 60% based on the hardness at 25° C. Compared with this, in the case of the sintered alloy article of Example 4, the Vickers hardness number at 700° C is about 500 $H_v$ which is higher than that of Stelite No. 6 at 25° C and about 77% based on that at 25° C.

EXAMPLE 5

Procedures identical to those in Example 4 were repeated with the exception that the finely divided component alloy and ferrous base metal were used in amounts of 20% and 7% by weight, respectively, to provide 100 sintered powdered alloy valve sheet rings. Each of the resultant valve sheet rings consisted of 1.2% by weight of carbon, 4.0% of chromium, 1.6% of nickel, 4.0% of molybdenum, 6.4% of cobalt, 0.4% of niobium and the balance of iron and had a Rockwell hardness number of 91 $H_RB$ and a density of 6.7 g/cm³.

The valve sheet rings were subjected to internal cutting and chamferring at an angle of 20° from the end surface thereof under the conditions indicated in Table 3.

Table 3

| Item | Operation: Internal cutting | Chamferring |
|---|---|---|
| Material for tip of cutting tool | Mitsubishi Diatitanit HTi 10* | Mitsubishi Diatitanit HTi 10 |
| Configuration of tip of cutting tool | 0°10°6°6°8°30° 0.8R | 0°1°6°6°45°20° |
| Number of rotations of main shaft of cutting machine (rpm) | 714 | 714 |
| Speed of cutting mm/min | 52–74 | 58–76 |
| Feed speed mm/rev | 0.15 | 0.15 |
| Depth of cut mm | 2ϕ | 2×5 |

*Trademark of cutting tool made by Mitsubishi Metal Co., Ltd. in accordance with JIS K 10

The valve sheet rings were subject to internal cutting and chamferring so as to observe abrasion of the cutting tools used for the above operations. That is, the decrease in length of the tips of the cutting tools due to the abrasion was measured for each internal cutting and the chamferring. The results for the internal cutting and the chamferring are indicated by Curve C in FIG. 4 and by Curve E in FIG. 5, respectively.

For comparison purposes, procedures identical to those mentioned above were repeated, except that the comparison valve sheet rings of the sintered powdered alloy were produced by the same process as in Comparison Example 1. The comparison valve sheet rings had a Rockwell hardness number of 87 $H_RB$ and a density of 6.7 g/cm³. The results for the internal cutting and the chamferring are indicated by Curve D in FIG. 4 and by Curve F in FIG. 5, respectively.

Figure 4:
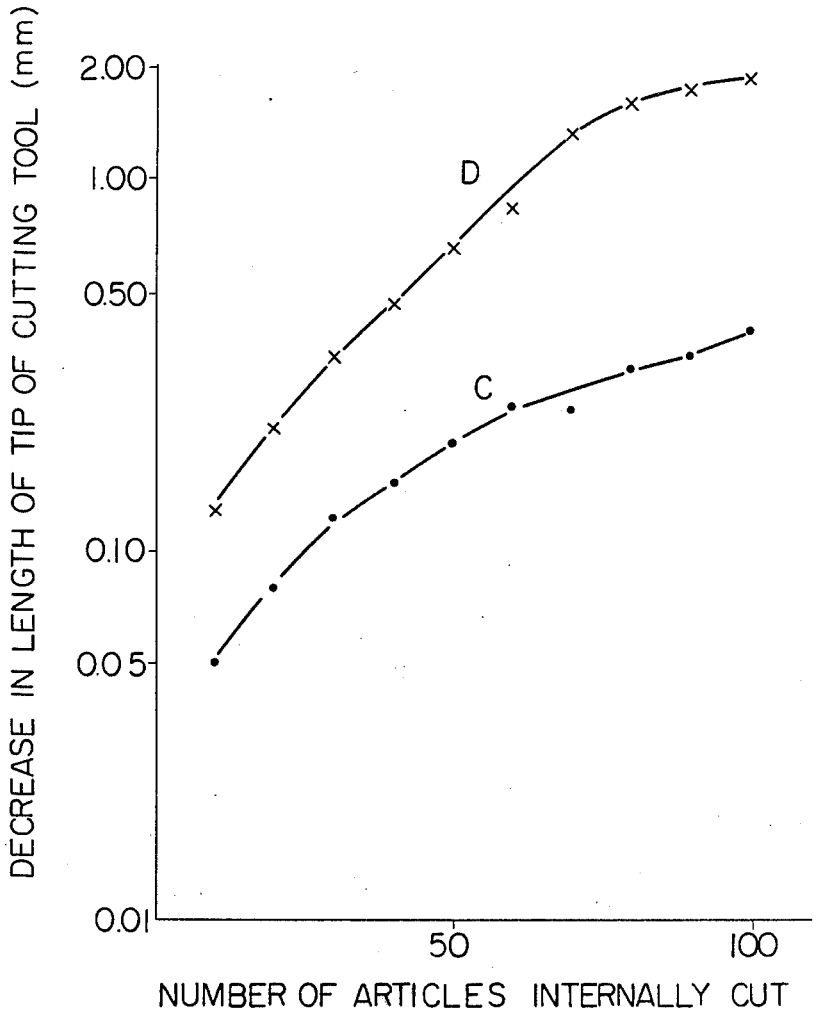
FIG. 4 shows a relationship of the decrease in length of a tip of a cutting tool to the number of sintered powdered alloy articles of the present invention internally cut with the cutting tool, in comparison with that of conventional sintered powdered alloy articles.
Figure 5:
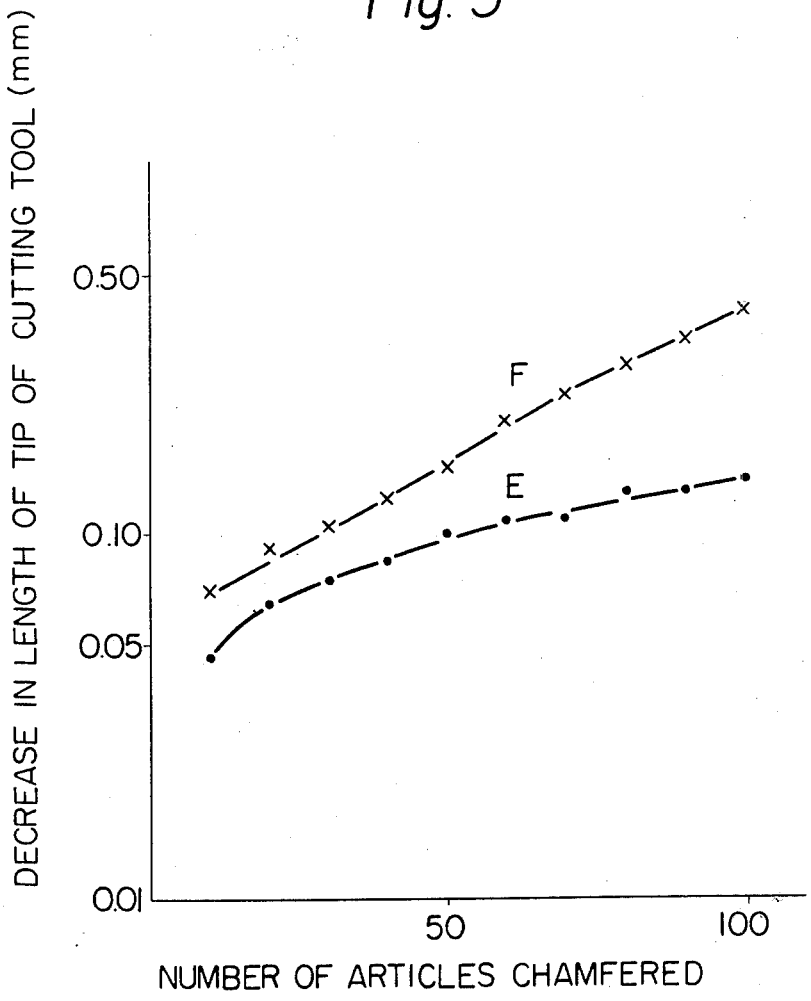
FIG. 5 shows a relationship of the decrease in length of a tip of a cutting tool to the number of sintered powdered alloy articles of the present invention chamfered with the cutting tool, in comparison with that of conventional sintered powdered alloy articles.

FIGS. 4 and 5 show that in the internal cutting and the chamferring of the valve sheet rings, the sintered powdered alloy of the present invention cause less abrasion of the tips of cutting tools than that of the comparison example. That is, it is evident that the sintered powdered alloy article of the present invention has a higher workability than that of the conventional type of sintered powdered alloy article.

EXAMPLE 6

An exhaust valve sheet ring for a four cylinder internal combustion engine was prepared from a sintered powdered alloy by the same procedures as described in Example 3. The resultant exhaust valve sheet ring was set up in a 1200 cc four cylinder internal combustion engine. The engine was run using leadless gasoline under a full load of 4000 rpm for 100 hours in order to test the durability of the valve sheet ring. After the running of the engine was completed, the change in tappet clearance due to the abrasion of the valve sheet ring was measured.

For comparison purposes, the same procedures as above were repeated using a cast steel consisting of 0.5% by weight of chromium, 2% by weight of nickel, 10% by weight of cobalt, 5% by weight of molybdenum and the balance of iron, in place of the sintered powdered alloy.

For the purpose of another comparison, the same procedures as mentioned above were repeated again using a steel SUH 4B.

The results are indicated in Table 4.

Table 4

| Material | Change in tappet clearance (mm) |
|---|---|
| Sintered powdered alloy of Example 6 | 0.01 |
| Cast steel | 0.08 |
| Steel SUH 4B | 0.15 |

Table 4 shows that the valve sheet ring produced in accordance with the process of the present invention has a higher heat resistance and abrasion resistance than the conventional valve sheet rings.

What we claim is:

1. A process for producing a sintered powdered ferrous alloy article having high heat resistance and abrasion resistance, comprising:

admixing (1) 5 to 30% by weight of finely divided component alloy which consists of the following composition,

| | |
|---|---|
| 1 to 4% by weight | carbon |
| 10 to 30% by weight | chromium |
| 2 to 15% by weight | nickel |
| 10 to 30% by weight | molybdenum |
| 20 to 40% by weight | cobalt |
| 1 to 5% by weight | niobium |
| the balance | iron, |

(2) 0.8 to 2% by weight of finely divided carbon and (3) the balance consisting of a finely divided ferrous base metal;

compression molding said admixture under a pressure of 4 to 6 metric tons/cm$^2$, and;

sintering said molded admixture in a reducing atmosphere at a temperature of 1050° to 1150° C.

2. A process as claimed in claim 1, wherein the particles of said finely divided component alloy have a size of 150 microns or smaller.

3. A process as claimed in claim 2, wherein said size of said particles of said finely divided component alloy ranges from 100 to 150 microns.

4. A process as claimed in claim 1, wherein said finely divided component alloy contains a complex carbide of chromium, molybdenum and niobium, and a simple carbide of niobium.

5. A process as claimed in claim 1, wherein said finely divided component alloy is in an amount of 10 to 20% by weight, said finely divided carbon in an amount of 1.0 to 1.5% by weight and said finely divided ferrous base metal in an amount of 78.5 to 89% by weight.

6. A process as claimed in claim 1, wherein said reducing atmosphere consists of a reducing gas selected from the group consisting of hydrogen, heat-decomposed ammonia gas and end thermic gas.

7. A sintered powdered ferrous alloy article having high heat resistance and abrasion resistance, comprising:

1. 5 to 30% by weight of a finely divided component alloy which consists of the following composition,

| | |
|---|---|
| 1 to 4% by weight | carbon |
| 10 to 30% by weight | chromium |
| 2 to 15% by weight | nickel |
| 10 to 30% by weight | molybdenum |
| 20 to 40% by weight | cobalt |
| 1 to 5% by weight | niobium |
| the balance | iron, |

2. 0.8 to 2% by weight of finely divided carbon, and;
3. the balance consisting of finely divided ferrous base metal;

admixed together, compression-molded under a pressure of 4 to 6 metric tons/cm$^2$ and, then, sintered in a reducing atmosphere at a temperature of 1050 to 1150° C;

the particles of said finely divided component alloy being dispersed in a matrix component formed from said finely divided carbon and ferrous base metal, and being firmly bonded to said matrix with bonding phases formed around said particles and consisting of portions of said matrix and portions of said finely divided component alloy diffused into said portions of said matrix.

* * * * *